US007726824B2

(12) United States Patent
Cranor et al.

(10) Patent No.: US 7,726,824 B2
(45) Date of Patent: Jun. 1, 2010

(54) CHEMILUMINESCENT TACTICAL ILLUMINATION BATON

(75) Inventors: Earl Cranor, Longmeadow, MA (US); Joseph Cosimo Longo, Feeding Hills, MA (US)

(73) Assignee: Cyalume Technologies, Inc., West Springfield, MA (US)

( * ) Notice: Subject to any disclaimer, the term of this patent is extended or adjusted under 35 U.S.C. 154(b) by 33 days.

(21) Appl. No.: 11/971,636

(22) Filed: Jan. 9, 2008

(65) Prior Publication Data

US 2009/0175024 A1 Jul. 9, 2009

(51) Int. Cl.
*F21K 2/00* (2006.01)

(52) U.S. Cl. ..... 362/34; 362/84

(58) Field of Classification Search ..... 362/34, 362/84

See application file for complete search history.

(56) References Cited

U.S. PATENT DOCUMENTS 3,539,794 A 11/1970 McKay
3,576,987 A 5/1971 Voight
3,597,362 A 8/1971 Bollyky
4,796,161 A 1/1989 Savariego
5,222,798 A 6/1993 Adams
5,370,828 A * 12/1994 Ladyjensky ..... 252/700
2007/0133935 A1* 6/2007 Fine ..... 385/131

* cited by examiner

*Primary Examiner*—John A Ward
(74) *Attorney, Agent, or Firm*—McHale & Slavin, P.A.

(57) ABSTRACT

A light stick for providing chemiluminescent light to provide general illumination of an otherwise darkened area. The device is thrown into position causing the chemiluminescent components to mix upon impact with a rigid object thereby generating chemiluminescent light after a predetermined delay. The device will provide illumination to an area of possible criminal activity and can be used tactically by law enforcement officials to help avoid danger to themselves and possibly others.

1 Claim, 2 Drawing Sheets

CHEMILUMINESCENT TACTICAL ILLUMINATION BATON

FIELD OF THE INVENTION

The present invention is directed to the field of portable lighting devices and in particular to a self energized portable light source usable by first responders such as fireman and law enforcement personnel to illuminate areas without substantial risk to themselves or those others in the immediate area. The invention is directed to a device that will provide remote tactical illumination of a hazardous location such as active crime scene.

BACKGROUND OF THE INVENTION

The need for portable lighting devices is well known. However, the application of such a device can be for nearly any low level lighting condition. For instance, in the normal course of duty law enforcement officials may find the need to enter non-illuminated streets, alleys or buildings at night. Unfortunately, it is common practice for criminals to use the cover of darkness to hide their activities. Drug dealing is just one type of activity typically occurring during the night time hours. Another criminal activity is burglary wherein the thief or thieves break into a building with the intent to steal some or all of its contents.

Very often law enforcement officials' need to respond to alarm systems that either silently or openly announce the unauthorized entry of a building. Policemen routinely on patrol at night often enter unlighted areas to investigate suspicious looking activity. When entering these types of non illuminated areas the officers are subjecting themselves to high levels of vulnerability and potential danger. Their potential adversary having the upper hand being in a defensive position and having already familiarized themselves with the immediate surroundings.

It is also not unusual for violent criminals, drug users, terrorists, or other unsavory characters to resist capture by the use of deadly force. Likewise, it is not unusual for the common criminal to have automatic and/or high caliber weapons capable of extremely deadly force. The criminal's wanton disregard for human life, their drive to evade capture, their ability to obtain high powered weaponry and the cover of darkness makes law enforcement a very dangerous profession.

At present, it is common for law enforcement officials to use a hand held flashlight when they need to enter non-illuminated streets, alleys, or rooms at night. The use of a hand held flashlight often acts as a warning signal for the criminal and makes the law enforcement official an easy target by giving away his/her position. Under most circumstances there is a lag time between the officer's energization of their flashlight and their visual location of the person(s) within the field of illumination. As the officer surveys the scene there is an additional time lag as he or she investigates the area while holding a flashlight in one hand and preparing for use of their weapon with the other hand. These hesitations, which may only be a matter of seconds, or fractions of a second, leave the officer exposed to a potentially deadly ambush by the criminal or criminals lurking in the dark. Thus, what is needed in the art is a multifunction baton that can used by an officer and the like personnel for self protection, and can further be used to illuminate a darkened area without revealing the location of the officer.

DESCRIPTION OF THE PRIOR ART

The prior art contains portable devices designed for use by law enforcement and the like personnel to temporarily illuminate hazardous dark area. These devices contain a self powered source of visible light that can be thrown or launched, preferably while it is still dark, into a region requiring illumination. After being properly situated the light source automatically commences to provide light illumination.

U.S. Pat. No. 5,222,798, to Craig Adams, discloses a portable light source of bright light usable as a non-injurious agent of coercive intervention by law enforcement and public safety personnel to manipulate the environment, including human actors within the environment, without appreciable risk of injury to either the personnel or to the actors. The device includes an electrical light source capable of producing a very bright light. The light source is contained within an armored case. The armored case is sufficiently strong as to substantially prevent a human from disabling the bright light source by manual force alone, without the use of tools or other implements. The intended use of the light source is analogous to a grenade. When the policeman, fireman or the like desires to illuminate a potentially hazardous location, he/she arms the light source, in the manner of a grenade by a pulling of a pin. Then, following a predetermined delay time interval, the person arming the light source throws or otherwise launches it into a darkened area to be investigated. In this manner the light source may be moved into position by law enforcement personnel without requiring them to illuminate themselves, thereby possibly exposing themselves to hazards such as gunfire.

U.S. Pat. No. 4,796,161, to Meir Savariego, is directed to an apparatus which provides simultaneous actuation of a plurality of light sources to provide an apparatus capable of producing an intense light at a precisely selectable time. The device provides an apparatus for providing simultaneous actuation of a plurality of elongate chemical light sources that are actuated by bending thereof. The device includes a spring loaded actuator that is capable of simultaneously bending the plurality of elongated chemical light sources. The device has an operative configuration of a hand grenade whereby release of a retaining pin and subsequent release of a retaining handle very quickly produces and intense source of light. The chemical light sources disclosed in this patent are identified as those described in U.S. Pat. Nos. 3,539,794; 3,576,987 and 3,597,362.

U.S. Pat. No. 3,539,794, to M. McKay Rauhut et al is directed to a self contained chemiluminescent lighting system. The device includes a closed container which is light transmitting for containing and displaying a chemiluminescent mixture and additional means to maintain the components of the mixture separated and non reactive until the light display is desired. The device may have an outer transparent container, flexible or rigid, which is divided into separate compartments by a rupturable or removable wall. It may be a flexible, transparent container, divided into two compartments by a clamp applied externally or by a seal between opposed layers of the container. It can also be a transparent flexible container having a separate inner container being itself flexible or rigid. Alternatively, the inner container may be rupturable or openable by means external to the outer container. In addition, the device may consist of a series of elongated flexible containers in a ribbon form.

U.S. Pat. No. 3,576,987, to Voight et al, is directed to a device for the storage and subsequent admixture and display of a multicomponent chemiluminescent system. The device consists of an elongated transparent or translucent flexible outer tube and a rigid breakable inner tube which runs parallel tube and which preferably is joined to the outer tube, or relatively fixed at its ends with respect to the inner tube. The inner tube is filled with one component of a two component chemical lighting system. The outer tube is filed with the second component. The outer tube is capped at both ends with a closure which may contain a recess which fits around the inner tube to hold it in place and which, if desired, may serve as a closure for one end of the inner tube. In an alternative embodiment the inner tube is sealed and attached to the outer tube at the ends or along the longitudinal side.

SUMMARY OF THE INVENTION

The present invention discloses an illumination device that is remotely activated and deployed into a non illuminated area. The invention is an improvement of a conventional chemiluminescent light stick. A conventional chemiluminescent device is sealed in a plastic cylinder containing two liquids that are placed in separate containers. The liquids are maintained in a separated state by encapsulating one in a sealed glass vial that is suspended in a second liquid contained in the plastic cylinder. A conventional chemiluminescent device, because of its construction and design, is not subject to casual activation. Rather, a conventional chemiluminescent device requires forceful deformation, such as bending, of the plastic cylinder to break the glass vial contained with the cylinder to cause the two liquids to mix.

The plastics utilized in conventional chemiluminescent devices are therefore designed to be flexible at room temperature and must, due to the nature of chemiluminescent liquids be polyolefins. However, in general, polyolefins are either very brittle at low temperatures, temperatures at or below freezing, or begin loosing their physical strength (ability to withstand rupture) at higher temperatures, such as temperatures above 130° F. In addition, the light generated by a conventional chemiluminescent light stick is, generally speaking, only sufficient to produce enough light to be seen, such as a visual indicator rather than sufficient light to illuminate an otherwise darkened area.

The chemiluminescent light stick of the present invention provides a simple and elegant solution to a serious problem concerning the safety of law enforcement officers. The light stick of the present invention is designed to cause the glass vial within the plastic cylinder to rupture when thrown against a solid object, such as a wall, a floor or the ground. It contains and enhanced catalytic system that causes the chemical reaction to occur rapidly, from within seconds to minutes. Likewise, the chemiluminescent material is capable of providing a brief and intense bright burst of illumination. This accelerated kinetic reaction rate results in an almost instantaneous generation of carbon dioxide that can generate a pressure within the plastic cylinder in excess of 400 psig. A cylinder of multi-ply polyolefin construction is capable of withstanding the instantaneous pressure increase within the cylinder from temperatures from below freezing to above 130° F. while at the same time providing the necessary flexibility to enable the glass vial to rupture when the cylinder to subjected to a requisite impact.

Accordingly, it is an objective of the instant invention to provide a chemiluminescent light stick based baton, wherein the device can be used in self protection similar to a conventional baton, and can be further used for illumination of a darkened area without revealing the location of the original holder of the device.

It is a further objective of the instant invention to provide a chemiluminescent light stick that will produce enough light to illuminate a large area in an emergency tactical situation.

It is yet another objective of the instant invention to provide a chemiluminescent light stick that will operate under a wide variety of weather conditions and in particular extreme temperature.

It is a still further objective of the invention to provide a chemiluminescent light stick that is easy and safe to use, easy to transport, simple and economical in design and will help protect those who would otherwise be in dangers way.

Still another objective of the instant invention is to provide a baton that thrown in an unlit condition, thereby not revealing the locating of the person throwing the baton, wherein upon impact the baton is activated for purposes of illuminating an area.

Yet another objective of the instant invention is to provide a baton device that may be used by law enforcement during civil unrest, a first impact of the baton causing activation wherein the baton is pressurized forming rigid construction.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
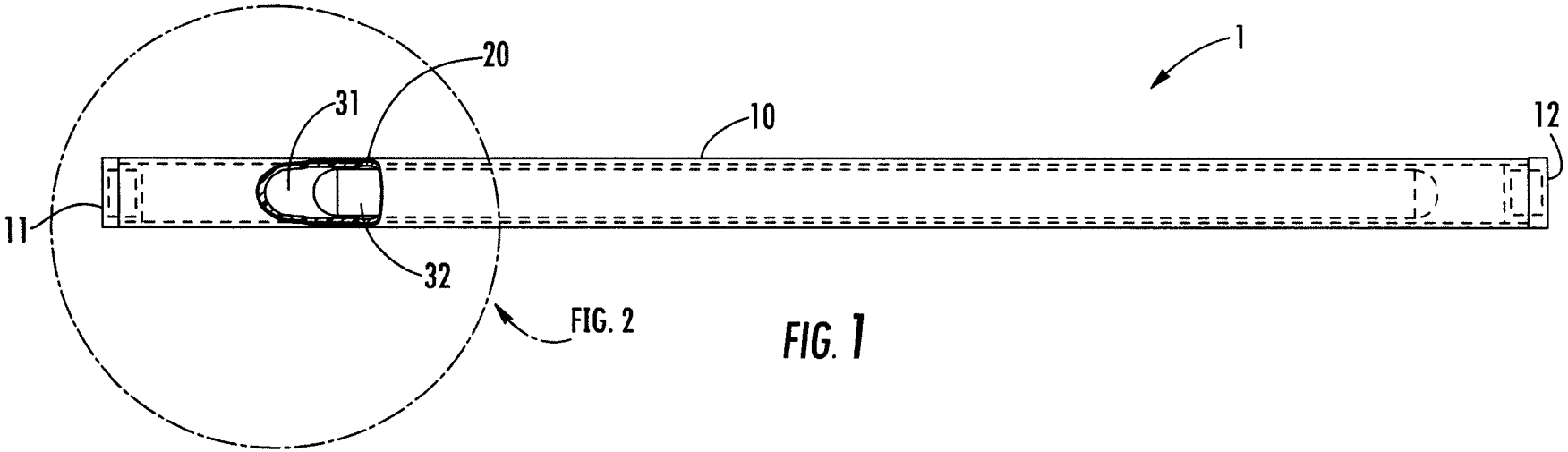
FIG. 1 is a partial sectional view of the light stick of the present invention.
Figure 2:
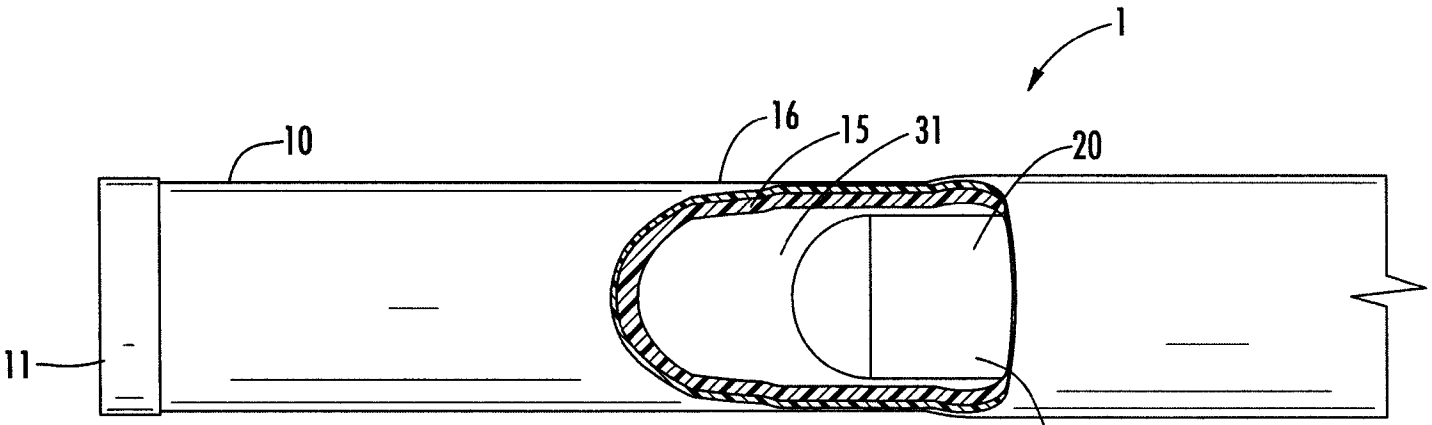
FIG. 2 is enlarged view of the sectional area shown in FIG. 1.
Figure 3:
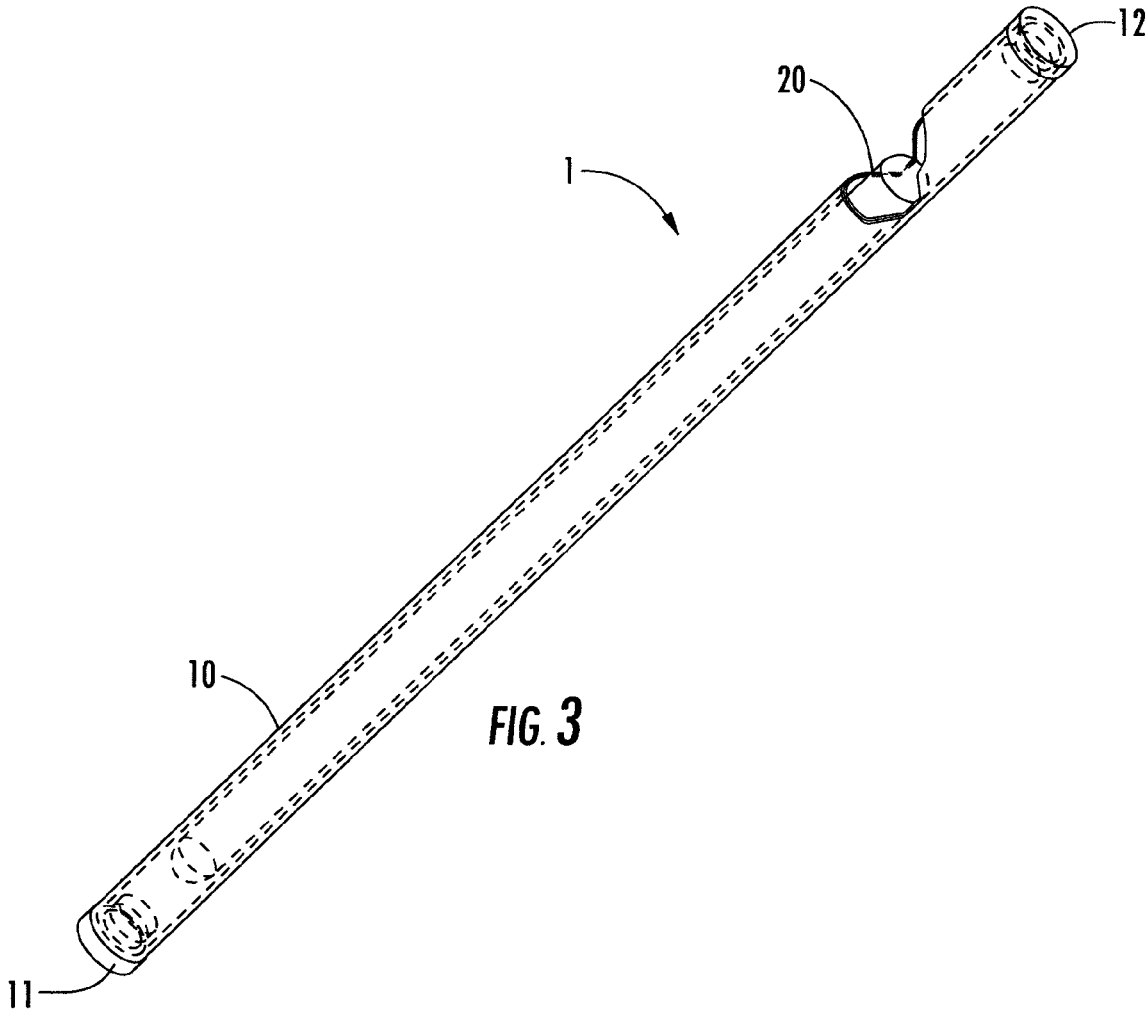
FIG. 3 is a perspective view, shown partially in section, of the present invention.

Referring to FIGS. 1 and 2, the device 1 comprises a cylindrical tube 10 having an end cap 11 on one end of the cylindrical tube 10 and another end cap 12 on the opposite end of cylindrical tube 10. Cylindrical tube 10 is sized to receive a cylindrical glass vial (or ampoule) 20. While vial 20 is disclosed as being made of glass it recognized that any other suitable rigid breakable material could be used a well. The outer diameter of vial 20 is slightly smaller than the internal diameter of cylindrical tube 10 and has a length substantially equivalent to the length of the cylindrical tube 10. The length of the cylindrical tube 10 and the vial 20 is greater than ten times their diameter. This results in a device that will break the vial 20 upon any flexion of the tube 10 such as would occur should a law enforcement officer throw the stick into an area and strike it against a hard surface, such as a wall or floor.

Cylindrical tube 10 is filled with first reactive component 31 of a two part chemiluminescent material and well as vial 20. Vial 20 is filled with a second reactive component 32 of a two part chemiluminescent material. The basic chemiluminescent process produces light when two chemical solutions are combined. The solutions may be combined and frozen to prevent activation or can be kept physically separated prior to activation. Physical separation typically consists of a sealed frangible glass vial containing a first solution that is placed within a second solution, both of which are housed in a sealed flexible vessel. When the vessel is flexed, the glass vial is ruptured thereby releasing the vial solution which admixes wherein the reaction produces light. The chemical solutions are generally referred to as the "oxalate" component and the "activator" component. A typical oxalate component consists of Dibutyl Phthalate, CPPO and CBPEA. A typical activator solution contains Dimethyl Phthalate, T-butyl alcohol, 90% aq. Hydrogen Peroxide and Sodium Salicylate.

When the vial 20 is ruptured the first reactive component 31 and the second reactive component 32 are brought into contact to produce the reaction which cause chemiluminescent light to be generated with the cylinder 10. The reaction of the two components produces large amounts of carbon dioxide as a by-product of the reaction.

The cylinder 10 is a multi-ply plastic cylinder incorporating layers of polyolefins 15 and 16 having disparate physical properties thereby resulting in a cylinder that can withstand the instantaneous pressure build from temperatures from below freezing to above 130° F. The accelerated kinetic reaction rate results in an almost instantaneous generation of carbon dioxide that will result in an internal pressure within the cylindrical tube 10 in excess of 400 psig. The inner layer 15 is made from a low density polyolefin and is chosen from the family of polyolefins that is typically used for cold food storage (like freezer bags). The outer layer 16 is a high density polyolefin modified with 40% by weight with ethylene vinyl acetate and was chosen from the family of polyolefins that is typically used for warm food storage (like microwave containers). The inner layer gives the cold temperature strength and flexibility, and, the outer layer survives the high temperatures. The polyolefin layers 15 and 16 are made from translucent or transparent material to allow the chemiluminescent light to emanate from the light stick 1.

In operation, the law enforcement officer, fireman, or first responder will be transporting light sticks 1 within their vehicles. Upon leaving their vehicles to conduct an on foot investigation the officer would place one or more light sticks in their utility belt or otherwise carry them on their person. Prior to entering a dangerous unlighted area the officer would take a light baton in their hand and throw it into the general area with sufficient force to cause an impact of the light baton with a hard object within the area, such as a wall, floor, or street surface. The impact of the baton will cause the vial 20 to rupture. Within a short period of time, from a few seconds to minutes, the light baton 1 will generate enough chemiluminescent light to provide general illumination to an otherwise dark area and reveal any potential danger in the area without exposing or encumbering the police officer.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A baton shaped chemiluminescent light stick comprising;

a flexible light transmitting cylinder and a rigid cylindrical breakable vial; said flexible light transmitting cylinder containing said rigid breakable cylindrical vial and a first reactive component of a two part chemiluminescent material, said breakable vial containing a second reactive component of a two part chemiluminescent material;

said flexible light transmitting cylinder having an inner diameter and the rigid breakable vial having an outer diameter, the outer diameter of the rigid breakable vial being slightly smaller than the inner diameter of the flexible light transmitting cylinder, the lengths of the flexible light transmitting cylinder and the rigid breakable vial being substantially coextensive, said flexible light transmitting cylinder and rigid cylindrical breakable vial having a length over diameter ratio greater than 10 to 1, said flexible light transmitting cylinder formed from an inner layer made from a low density polyolefin chosen from the family of polyolefins that is typically used for cold food storage and an outer layer made from high density polyolefin modified with 40% by weight ethylene vinyl acetate and chosen from the family of polyolefins that is typically used for warm food storage, said inner and outer layer constructed and arranged to withstanding internal gas pressure up to 400 psig at temperatures ranging from 0 degrees Fahrenheit to 130 degrees Fahrenheit;

whereby when the light stick is thrown against a hard object the force of the impact is conducted through said flexible light transmitting cylinder and into the rigid breakable vial, rupturing said vial and causing said first and second reactive components to mix and generate a chemiluminescence.

* * * * *